United States Patent [19]

Swan, III

[11] Patent Number: 4,832,821

[45] Date of Patent: May 23, 1989

[54] CATALYST REFORMING PROCESS

[75] Inventor: George A. Swan, III, Baton Rouge, La.

[73] Assignee: Exxon Research and Engineering Company, Florham Park, N.J.

[21] Appl. No.: 164,660

[22] Filed: Mar. 7, 1988

[51] Int. Cl.[4] ..... C10G 35/06

[52] U.S. Cl. ..... 208/65

[58] Field of Search ..... 208/65

[56] References Cited

U.S. PATENT DOCUMENTS

| | | | |
|---|---|---|---|
| 2,899,378 | 8/1959 | Den Herder | 208/65 |
| 3,287,253 | 11/1966 | McHenry, Jr. et al. | 208/65 |
| 3,381,048 | 4/1968 | Lovell et al. | 585/482 |
| 3,573,199 | 3/1971 | McCoy | 208/139 |
| 3,649,524 | 3/1972 | Derr et al. | 208/139 |
| 4,191,633 | 3/1980 | Druber | 208/65 |
| 4,375,405 | 3/1983 | Garvert | 208/134 |

*Primary Examiner*—Curtis R. Davis

*Attorney, Agent, or Firm*—Henry E. Naylor

[57] ABSTRACT

Disclosed is an improved method for catalytically reforming a gasoline boiling range naphtha in a reforming unit comprised of a plurality of serially connected reactors, each containing a halogenated reforming catalyst. The level of halide is maintained in each reactor, particularly the downstream reactors by injecting into each reactor a mixture of water and halide at a ratio of 20:1 to 60:1, respectively.

6 Claims, 1 Drawing Sheet

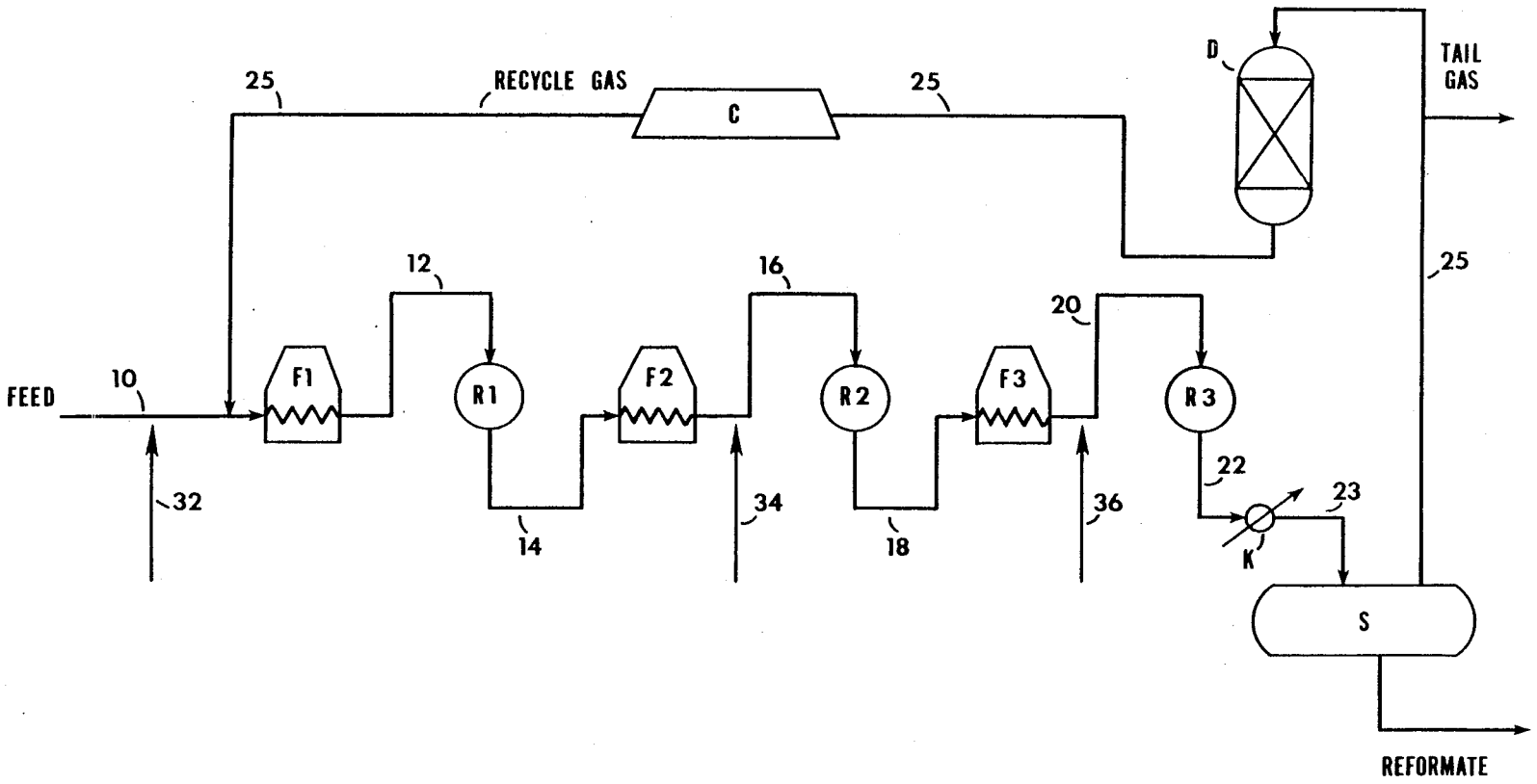
TAIL GAS
25
REFORMATE
S
23
K
D
22
R3
36
20
F3
25
18
R2
16
34
C
F2
RECYCLE GAS
14
R1
12
F1
25
32
10
FEED

CATALYST REFORMING PROCESS

FIELD OF THE INVENTION

The present invention relates to a catalytic reforming process with improved on-stream chlorination to maintain catalyst acidity.

BACKGROUND AND PROBLEMS

Catalytic reforming, or hydroforming, is a well established refinery process for improving the octane quality of naphthas or straight run gasolines. Reforming can be defined as the total effect of the molecular changes, or hydrocarbon reactions, produced by dehydrogenation of cyclohexanes, and dehydroisomerization of alkylcyclopentanes to yield aromatics; dehydrogenation of paraffins to yield olefins; dehydrocyclization of paraffins and olefins to yield aromatics; isomerization of n-paraffins; isomerization of alkylcycloparaffins to yield cyclohexanes; isomerization of substituted aromatics; and hydrocracking of paraffins which produces gas, and inevitably coke, the latter being deposited on the catalyst. In catalytic reforming, a multi-functional catalyst is usually employed which contains a metal hydrogenation-dehydrogenation (hydrogen transfer) component, or components, usually platinum, substantially atomically dispersed upon the surface of a porous, inorganic oxide support, such as alumina. The alumina support, which usually contains a halide, particularly chloride, provides the acid functionality needed for isomerization, cyclization, and hydrocracking reactions.

Reforming reactions are both endothermic and exothermic, the former being predominant, particularly in the early stages of reforming with the latter being predominant in the latter stages. In view thereof, it has become the practice to employ a reforming unit comprised of a plurality of serially connected reactors with provision for heating of the reaction stream from one reactor to another. There are three major types of reforming: semi-regenerative, cyclic, and continuous. Fixed-bed reactors are usually employed in semi-regenerative and cyclic reforming amd moving-bed reactors in continuous reforming. In semi-regenerative reforming, the entire reforming process is operated by gradually and progressively increasing the temperature to compensate for deactivation of the catalyst caused by coke deposition, until finally the entire unit is shutdown for regeneration and reactivation of the catalyst. In cyclic reforming, the reactors are individually isolated, or in effect swung out of line, by various piping arrangements. The catalyst is regenerated by removing coke deposits, and then reactivated while the other reactors of the series remain on stream. A "swing reactor" temporarily replaces a reactor which is removed from the series for regeneration and reactivation of the catalyst, which is then put back in series. In continuous reforming, the reactors are moving-bed reactors as opposed to fixed-bed reactors, with continuous addition and withdrawal of catalyst.

All of the reforming catalysts in general use today contain platinum supported on an alumina or an alumina-silica base. In many cases, rhenium is combined with platinum to form a more stable catalyst which permits operation at lower pressures. As previously mentioned, platinum is thought to serve as a catalytic site for hydrogenation and dehydrogenation reactions and halogenated alumina provides an acid site for isomerization, cyclization, and hydrocracking reactions. Halide, particularly chloride, is known to be a catalyst promoter when added to a reforming catalyst in catalyst-promoter quantities since larger amounts can cause excessive undesirable hydrocracking reactions. While most feeds contain small amounts of halide, it is usually not enough to adequately maintain catalyst activity. Consequently, platinum-containing alumina-based reforming catalysts are manufactured having a predetermined amount of halide, particularly chloride, on catalyst, sometimes up to about 3 wt. %, depending on the active metals content of the catalyst. As the catalyst ages, chloride loss becomes appreciable and, inter alia, contributes to loss of catalyst activity. Various approaches have been taken to address the need for maintaining desirable levels of halide on catalyst, as well as preventing its loss when onstream. For example, U.S. Pat. No. 2,899,378 teaches a reforming process wherein dry halide, in the form of a halogen, halide acid, or an alkyl halide, is injected into one or more series reactors to maintain the halide concentration within the desired range.

Also, U.S. Pat. No. 3,287,253 teaches a staged reforming process in which a platinum-alumina catalyst used in a third reactor is chlorinated by introducing a chloride-containing compound upstream thereof.

Further, U.S. Pat. No. 3,381,048 discloses the isomerization of xylene isomers over a regenerable platinum-alumina-halogen catalyst in which the chloride is maintained at a certain level by addition of a chloride-containing substance to the feed, or by treating the catalyst directly with a chloride-containing substance.

It is suggested in U.S. Pat. No. 3,573,199 that the acidity, or activity, of a reforming catalyst can be controlled by using a selected temperature range and water content. This allegedly allows a more uniform distribution of halide throughout the catalyst. It is also suggested in this reference that for several reactors in series, proper allocation of halide in each reactor can be obtained. It is to be noted, however, that in the process of this reference, halide addition is discontinuous, the temperature level and water concentration is adjusted prior to halide injection, and the halide concentration on catalyst, in fact, increases in downstream reactors.

U.S. Pat. No. 3,649,524 teaches on-stream chlorination wherein water is injected upstream of a first reactor to maintain a water level throughout the series of reactors at 5 to 25 vppm, and chloride is injected upstream of each reactor to provide a chloride to water molar ratio of about 0.05 to about 1. Such an approach results in overchlorination of the catalyst, thus contributing to elevated acid cracking and loss of activity and selectivity.

While these various attempts have been made to optimize the use of halide as a promoter for reforming catalyst, there still exists a need in the art for still improved methods for maintaining a predetermined optimum level of halide throughout a series of reactors of a reforming process unit.

SUMMARY OF THE INVENTION

In accordance with the present invention, there is provided an improved process for catalytically reforming a gasoline boiling range naptha, with hydrogen, in a reforming process unit comprised of a plurality of serially connected reactors, inclusive of a lead reactor and one or more downstream reactors, the last of which is the tail reactor, each of which contains a halogenated reforming catalyst comprised of a halide, platinum, and an inorganic oxide support. The improvement comprises the injection of water and halide in one or more of the downstream and tail reactors at a molar ratio of about 20:1 to 60:1 so as to maintain the level of halide on catalyst from about 0.5 to 1.5 wt. % based on the total weight of catalyst.

In preferred embodiments of the present invention, the halogen level is maintained at a level from about 0.8 to about 1 wt. % and the halogen is chloride.

In other preferred embodiments of the present invention water and chloride in a molar ratio of about 20:1 to 60:1 is also injected in the lead reactor.

In still other preferred embodiments, the molar ratio of water to chloride is from about 40:1 to 60:1.

BRIEF DESCRIPTION OF THE FIGURES

The sole FIGURE hereof is a simplified flow diagram showing a preferred reforming process unit comprised of a plurality of serially connected reactors and related apparatus.

DETAILED DESCRIPTION OF THE INVENTION

Feedstocks which are suitable for reforming in accordance with the instant invention are any hydrocarbonaceous feedstock boiling in the gasoline range. Nonlimiting examples of such feedstocks include the light hydrocarbon oils boiling from about 70° to about 500° F., preferably from about 180° to about 400° F. Nonlimiting examples of such feedstocks include straight run naphtha, synthetically produced naphtha, thermally or catalytically cracked naphtha, hydrocracked naphtha, or blends or fractions thereof.

Referring now to the FIGURE, a feedstock, which preferably is first hydrotreated by any conventional hydrotreating method, is passed along with a hydrogen rich-gas via line 10 to a heater, or preheat furnace $F_1$, where it is heated to an effective reforming temperature; that is, to a temperature high enough to initiate and maintain dehydrogenation reactions, but not so high as to cause excessive hydrocracking. Typically, this temperature will range from about 700° F. to about 1200° F., preferably from about 800° F. to about 1000° F., and more preferably from about 850° F. to about 950° F. The heated feedstock is then fed, via line 12, to reactor $R_1$ which contains a catalyst suitable for reforming. Reactor $R_1$, as well as all the other reactors in the reforming process unit, is operated at reforming conditions. Typically reforming operating conditions include the above mentioned temperatures; a reactor pressure from about 30 psig to about 1,000 psig, preferably from about 30 psig to about 500 psig; a weight hourly space velocity (WHSV) of about 0.5 to about 20; preferably from about 1 to about 4; and a hydrogen to oil ratio of about 1 to 10 moles of hydrogen per mole of $C_5$+ feed.

The reaction product of reactor $R_1$ is fed to preheat furnace $F_2$ via line 14, then to reactor $R_2$ via line 16. Because of the loss of halide, especially in the downstream reactors, a mixture of water and halide is injected into line 16 via line 34, at a molar ratio of about 20:1 to about 60:1 water to halide to maintain the level of halide on catalyst at about 0.5 to 1.5 wt. %, preferably from about 0.7 to 1.1 wt. %, and more preferably from about 0.8 to about 1 wt. %. It is critical that a mixture of water and halide be injected instead of halide alone. Water is needed to adjust the halide equilibrium in the reactor as well as to serve as a aid for keeping injection nozzles free from plugging by coke formation with chlorinated hydrocarbon injection. Conventional wisdom suggests that halide be injected only in the lead reactor and carried downstream to the tail reactors. This suffers from the disadvantage that not enough halide is left in the stream to maintain the desired level of halides throughout the reforming unit. If one tries to compensate for this by injecting still more halide in the lead reactor, then overhalogenation results, leading to undesirable high levels of cracking.

Returning now to the FIGURE, the reaction product of reactor $R_2$ is passed, via line 18, to preheat furnace $F_3$, then to reactor $R_3$ via line 20. Again, a mixture of water and halide, in the above discussed ratio, can be injected into line 20 via line 36 to maintain the desired level of halide in reactor $R_3$. It is also within the scope of the present invention that a mixture of water and halide in the same above ratios be injected into line 10, via line 32 to maintain the halide level in reactor $R_1$, if so needed. The reaction product of reactor $R_3$ is passed to Cooler K via line 22 where it is cooled to condense liquids, then passed to separator S via line 23 where a lighter gaseous stream is separator from a heavier liquid stream. The gaseous stream, which is hydrogen-rich, is recycled, via line 25 to line 10 by first passing it through drier D and compressor C to increase its pressure to feedstock pressure. Of course, during start-up, the reforming unit is pressured-up with hydrogen from an independent source until enough hydrogen can be generated for recycle. A portion of the hydrogen-rich gas can be taken off the top of the separator, and sent to a hydrofiner (not shown).

Catalysts suitable for use herein include both monometallic as well as multimetallic reforming catalysts. Preferred are the bifunctional reforming catalysts comprised of a hydrogenation-dehydrogenation function and a cracking function. The cracking function, which is important for isomerization reactions, is thought to be associated with a acid-acting material of the porous, adsorptive, refractory oxide type which serves as the support, or carrier, for the metal component, usually a Group VIII noble metal, to which is generally attributed the hydrogenation-dehydrogenation function. Preferably the Group VIII noble metal is platinum.

The catalyst may contain a halide component which contributes to the necessary acid functionality of the catalyst. The halide may be fluoride, chloride, iodine, bromide, or mixtures thereof. Of these, fluoride and chloride are preferred with chloride being more preferred. Generally, the amount of halide is such that the final catalyst composition will contain from about 0.1 to about 3.5 wt. %, preferably about 0.5 to about 1.5 wt. % of halogen calculated on an elemental basis.

Preferably, the platinum group metal will be present on the catalyst in an amount from about 0.01 to about 5 wt. %, calculated on an elemental basis, of the final catalytic composition. More preferably the catalyst comprises from about 0.1 to about 2 wt. % platinum group component, preferably platinum. Other preferred platinum group metals include palladium, iridium, rhodium, osmium, ruthenium and mixtures thereof.

The catalysts of the present invention may also include one or more Group IVA metals, such as germanium, tin, and lead. Preferred is tin, which can be present in the form of an oxide, sulfide, or elemental state in an amount from about 0.01 to about 5 wt. %, preferably from about 0.1 to about 3 wt. %, and more preferably from about 0.2 to about 3 wt. %, calculated on an elemental basis, and based on the total weight of the catalyst composition.

The catalyst may also include other components which act alone, or in concert, as modifiers to improve catalyst activity, selectivity, or stability. Examples of such components include antimony, arsenic, bismuth, cadmium, chromium, cobalt, copper, gallium, gold, indium, iron, manganese, nickel, rhenium, scandium, silver, tantalum, thallium, titanium, tungsten, uranium, zinc, and zirconium. Preferred is rhenium. It is preferred that these other components be present in the catalyst in an amount ranging from about 0.005 to about 5 wt. %, preferably from about 0.05 to about 2 wt%, and more preferably from about 0.05 to 1 wt. %.

While it is preferred that the support material of the catalyst compositions suitable for use herein be alumina or alumina-silica, other suitable refractory material may be used.

The invention, and its principle of operation, will be more fully understood by reference to the following examples, and comparative data provided by computer simulations from actual operations, which characterizes a preferred mode of operation.

COMPARATIVE EXAMPLE A AND EXAMPLE 1

Four serially connected reactors ($R_1$, $R_2$, $R_3$, $R_4$) reforming process unit are operated in semi-regenerative mode and contain a reforming catalyst comprised of 0.3 wt. % Pt, 0.3 wt. % Re, and 0.9 wt. % Cl on alumina with a surface area of 180 $m^2/g$. The unit is further operated at a pressure of 175 psig and a recycle gas rate of 4000 standard cubic feet per barrel of feed (4 kSCF/B) to achieve 98 RONC on a paraffinic Arabian naphtha comprised of 65.8 vol. % paraffins, 23 vol. % naphthalenes, and 11.2 vol. % aromatics. Water and chloride are only injected with introduction of feed to the first reactor at a water to chloride ratio of 0.6 wt. % for Comparative Example A whereas water and chloride are injected prior to each reactor to maintain the chloride on catalyst level at 0.85 wt. % for Example 1.

Table I below shows catalyst chloride progressively decreasing from the first reactor to the last reactor for comparative Example A, whereas catalyst chloride is maintained at a level of 0.85 wt. % in all reactors for Example 1. Maintaining the catalyst chloride level at 0.85 wt. % in all reactors results in a 30% activity advantage and 0.1 LV% $C_5$+ yield improvement over the base case where the water/chloride mixture is injected prior to the first reactor only.

TABLE I

| | Comp. Example A Base Case (Feed $H_2O$/Cl Only) | Example 1 Inter-Reactor $H_2O$/Cl Injection |
|---|---|---|
| Wt. % Cl on Cat | | |
| R1 | 0.85 | 0.85 |
| R2 | 0.80 | 0.85 |
| R3 | 0.70 | 0.85 |
| R4 | 0.60 | 0.85 |
| Wt. % Carbon on Cat | | |
| R1 | 1.9 | 1.8 |
| R2 | 3.8 | 3.6 |
| R3 | 5.4 | 5.1 |
| R4 | 6.4 | 6.0 |
| Average Temperature, °F. | | |
| R1 | 848 | 844 |
| R2 | 892 | 886 |
| R3 | 916 | 908 |
| R4 | 935 | 926 |
| Catalyst Activity Units | 41.6 | 54.1 |
| $C_5$+, LV % @ 98 RONC | 74.8 | 74.9 |

COMPARATIVE EXAMPLE B AND EXAMPLE 2

The above examples are followed except the feed is a more naphthenic West Texas feed comprised of 44.9 vol. % paraffins, 38.6 vol. % naphthenes, and 16.5 vol. % aromatics. The results are given in Table II below.

TABLE II

| | Comp. Example B Base Case (Feed Only) | Example 2 Inter-Reactor $H_2O$/Cl Injection |
|---|---|---|
| Wt. % Cl on Cat | | |
| R1 | 0.85 | 0.85 |
| R2 | 0.80 | 0.85 |
| R3 | 0.70 | 0.85 |
| R4 | 0.60 | 0.85 |
| Wt. % Carbon on Cat | | |
| R1 | 2.2 | 2.1 |
| R2 | 5.0 | 4.7 |
| R3 | 8.9 | 8.3 |
| R4 | 11.1 | 10.4 |
| Average Temperature, °F. | | |
| R1 | 838 | 834 |
| R2 | 880 | 873 |
| R3 | 927 | 918 |
| R4 | 946 | 938 |
| Catalyst Activity Units | 27.1 | 36.6 |
| $C_5$+, LV % @ 100 RONC | 78.0 | 78.3 |

A 35% activity advantage and 0.3 LV% $C_5$+ selectivity improvement are realized by better catalyst chloride maintenance in Example 2 as opposed to Comparative Example B.

The present invention is applicable to both semi-regenerative and semi-cyclic reforming units employing halide-containing reforming catalyst and may be applied to any or all reactors downstream of the first or lead reactor. For example, some benefit could be gained by practicing inter-reactor $H_2O$/Cl addition upstream of the tail, or final, reactor, in the series, provided the customary feed addition is also practiced. Water and chlorine addition ratios may be adjusted from 20:1 to 60:1 $H_2O$/Cl on a mole basis. At start of cycle with freshly regenerated catalyst, the ratio is approximately 40–60:1; this ratio must be lowered as deactivation and coke buildup increases, since equilibrium chloride on coked catalyst is lower than for fresh catalyst at the same $H_2O$/Cl mole ratio. Water and chloride addition rates must be adjusted to give only about 5–30 wppm $H_2O$ and about 1 wppm Cl on a fresh feed equivalent basis.

EXAMPLE 3

A reforming process unit having four serially connected reactors is operated in semi-regenerative mode at pressure of 225 psig, and a recycle gas rate of 4 kSCF/B to achieve 98 RONC. A recycle gas dryer containing a desiccant is used to remove water, chloride, and sulfur. The catalyst which will be used is comprised of 0.3 wt. % Pt, 0.3 wt. % Re, and 0.9 wt. % Cl on alumina with a surface area of 180 $m^2/g$ and is charged in the unit such that the first, or lead, reactor contains 11 wt. % of the total catalyst, with 22 wt. % in the second reactor, with 33.5 wt. % in each of the third and fourth reactors. The feed is an Aramco virgin naphtha with API gravity of 59.4, a boiling range from 180° F. to 340° F. (ASTM), and comprised of 68.4 vol. % paraffins, 18.4 vol. % naphthenes, and 15.6 vol. % aromatics. Further, the feed contains less than 0.5 wppm sulfur, less than 5 wppm water, and substantially no chloride. A mixture of chloropentane and butanol is injected at the inlet of each reactor to generate HCl and water at ratios which will maintain the catalyst chloride level between 0.8 to 0.9 wt. %. The butanol was added to given an equivalent 20 wppm water in liquid feed with 1 wppm equivalent chloride added. While chloropentane and butanol are used in this example, any appropriate chlorinated hydrocarbon and alcohol can be used.

Table III below shows the injection rate needed to maintain 0.8 to 0.9 wt. % chloride on catalyst during reforming with four reactors in semi-regenerative mode (55:1 $H_2O$:HCl mole ratio at inlet of each reactor).

TABLE III

| Reactor | Chloride g/bbl Feed | Water g/bbl Feed |
|---|---|---|
| 1 | 0.08 | 0.2 |
| 2 | 0.04 | 1.2 |
| 3 | 0.08 | 2.5 |
| 4 | 0.12 | 3.6 |

The above chloride and water injection rates were determined in order to compensate for the higher rate of chloride loss with progressively increasing temperature and higher coke in each successive reactor. Table IV below delineates the concentrations at each reactor inlet obtained via the above addition scheme:

TABLE IV

| Reactor | Cl Add'n Rate | Inlet $H_2O$ (vppm) | Inlet HCl (vppm) | $H_2O$:HCl |
|---|---|---|---|---|
| 1 | Base | 25 | 0.45 | 55.5:1 |
| 2 | 1.2 × Base | 30 | 0.55 | 54.5:1 |
| 3 | 1.5 × Base | 40 | 0.70 | 57.1:1 |
| 4 | 1.8 × Base | 45 | 0.80 | 56.2:1 |

Both chloride AND water injection are critical for the practice of the instant invention, otherwise the permissible chloride addition rate to satisfy the 0.8–0.9 wt. % Cl on catalyst requirement would have to be greatly reduced. For example, if water were introduced only in the feed to the lead reactor, the chloride addition rate at the tail reactor inlet would be only 0.75X Base and result in lower chloride on catalyst in the tail reactor.

The following average performance is achieved for this example:

| | |
|---|---|
| Catalyst Activity: | 58 |
| $C_5$+, LV % @ 98 RONC: | 72.6 |
| Hydrogen Yield, Wt. %: | 1.7 |
| Coke on Cat, Wt. %: | 5.5 |

COMPARATIVE EXAMPLE C

The same experiment as described in Example 3 above is conducted, except that the teaching of the prior art (U.S. Pat. No. 3,649,524) is followed whereby chloride is injected between each reactor with fixed water (20 wppm) in the naphtha feed. Furthermore, the middle of the recommended water:chloride range is employed, e.g., 5:1 $H_2O$:HCl to be achieved at the inlet of each reactor. This resulted in 1.45–1.55 wt. % chloride on catalyst in each reactor. At these high chloride levels significant cracking and loss of selectivity would occur. Coke on catalyst increased drastically due to the high cracking. Average performance of this run is summarized below:

| | |
|---|---|
| Catalyst Activity: | 29 |
| $C_5$+, LV % @ 98 RONC: | 64.8 |
| Hydrogen Yield, Wt. %: | 0.8 |
| Coke on Cat, Wt. %:. | 13.9 |

Comparison of these results with those of Example 3 show much better performance at the lower chloride on catalyst maintained with inter-reactor water/chloride injection.

EXAMPLE 4

Comparative Example C is repeated except that the water:chloride ratio is maintained at 20:1. With this water:chloride ratio, chloride on catalyst is 1.1–1.2 wt. %. Average unit performance is improved over that in Comparative Example C, but it is still less than that achieved in Example 3:

| | |
|---|---|
| Catalyst Activity: | 44 |
| $C_5$+, LV % @ 98 RONC: | 69.0 |
| Hydrogen Yield, Wt. %: | 1.3 |
| Coke on Cat, Wt. %: | 9.3 |

In Example 3, if the run had been continued to very high coke on catalyst, the water:chloride injection ratio would have been adjusted downward from 55:1 to about 40:1 or less in order to maintain adequate catalyst chloride in reactors 3 and 4, whereas the ratio in the upstream reactors would probably have been fixed at 50–55:1.

What is claimed is:

1. In a process for catalytically reforming a gasoline boiling range naphtha, with hydrogen, in a semi-regenerative or semi-cyclic reforming process unit comprised of a plurality of serially connected reactors, inclusive of a lead reactor and one or more downstream reactors, the last of which is the tail reactor, each of which contains a halogenated reforming catalyst comprised of a halide, a Group VIII noble metal, and an inorganic oxide support, the improvement which comprises continuously injecting into each downstream reactor a mixture of water and halide at a water to halide ratio from about 20:1 to about 60:1 wherein the specific ratio of water to halide for each individual downstream reactor is chosen so as to maintain the level of halide on catalyst in each downstream reactor from about 0.5 to 1.5 wt. % based on the total weight of the catalyst.

2. The process of claim 1 wherein the level of halide on catalyst is maintained at a about 0.8 to 1 wt. %.

3. The process of claim 1 wherein the halide is chloride.

4. The process of claim 1 wherein the ratio of water to chloride is from about 40:1 to about 60:1.

5. The process of claim 3 wherein the Group VIII metal is platinum, the inorganic oxide support is alumina, and the level of chloride is maintained from about 0.8 to 1 wt. %.

6. The process of claim 5 wherein the mixture of water and chloride is also injected into the lead reactor.

* * * * *